US005970118A

United States Patent [19]

Sokolov

[11] Patent Number: 5,970,118

[45] Date of Patent: Oct. 19, 1999

[54] CELLULAR X-RAY GRID

[76] Inventor: Oleg Sokolov, 64-39 98 St. Apt. 4B, Rego Park, N.Y. 11374

[21] Appl. No.: 08/924,497

[22] Filed: Aug. 27, 1997

Related U.S. Application Data

[63] Continuation of application No. 08/615,724, Mar. 14, 1996, abandoned, which is a continuation of application No. 08/370,827, Jan. 10, 1995, abandoned, which is a continuation of application No. 08/009,982, Jan. 27, 1993, abandoned.

[51] Int. Cl.[6] ..... G21K 1/00

[52] U.S. Cl. ..... 378/155; 250/505.1

[58] Field of Search ..... 378/155, 154; 250/505

[56] References Cited

U.S. PATENT DOCUMENTS

| | | | |
|---|---|---|---|
| 1,208,474 | 12/1916 | Caldwell | 378/155 |
| 2,336,026 | 12/1943 | Millenaar | 378/154 |
| 2,605,427 | 7/1952 | Delhumeau | 378/154 |
| 4,288,697 | 9/1981 | Albert | 250/505.1 |
| 4,414,679 | 11/1983 | Liebert et al. | 378/154 |
| 5,231,654 | 7/1993 | Kwasnick et al. | 378/154 |

*Primary Examiner*—Craig E. Church

[57] ABSTRACT

A cellular X-ray grid comprises a main grid portion having a plurality of cells separated from one another by a plurality of partitions, the main portion has on a plan view a side which extends parallel to a direction of movement of the grid during exposure, the cells having sides arranged so that the sides of the cells are not parallel to the side of the main portion which is parallel to the direction of movement of the grid and extend relative to the side of the main portion at such an angle as to erase an image of the cells on an X-ray picture during exposing with the movement of the grid, the cells contain gas or vacuum.

8 Claims, 1 Drawing Sheet

CELLULAR X-RAY GRID

This application is a continuation of application Ser. No. 08/615,724 filed on Mar. 14, 1996 now abandoned. Entitled: CELLULAR X-RAY GRID, which is continuation of application Ser. No. 08/370,827 filed Jan. 10, 1995, now abandoned, which is a continuation of application(s) Ser. No. 08/009,982 filed on Jan. 27, 1993 now abandoned.

BACKGROUND OF THE INVENTION

The present invention relates to cellular X-ray grids which are used in medical X-ray technique.

More particularly, it relates to a cellular X-ray grid which can be utilized during investigations conducted with X-rays in medicine as well as in other areas.

X-ray grids are known in which a lattice is composed of light sensitive glass which has slots or cells isolated from one another by specially oriented partitions which abosrb the X-ray radiation covered through the whole depth with an X-ray transmitting substance. Such a cellular X-ray grid is disclosed for example in the Soviet Inventor's Certificate No. 441109. The known grids possess several disadvantages. In the case of the cellular structure of the grid, with the size of the cell extending parallel to the direction of its movement during the exposure during exposure the complete erasing of the structure of the cells on the X-ray picture is not provided. This can lead to reduction of the informative capacity of the X-ray gram. A completely throughgoing perforated structure of the monolithic grid which is not reinforced mechanically at its ends and over its upper and lower surfaces does not provide a sufficient strength of the grid during bending and impact. The partitions which are covered with the X-ray non-transmitting layer over their full depth and which however do not have this coating at the end, can transmit a certain part of dispersed radiation through the non-protected ends. This also can somewhat reduce the informative property of the X-ray image. When the structural material is in the spaces in the cells or slots, the material absorbs a part of the information within long wave part of the exposing radiation which passes through the grid, since a great percentage of the long wave radiation is absorbed. It also reduces the informative property of the grid about the pathologies which are faintly distinguishable as to their density and sizes. This is very important for early or preventive diagnosis.

SUMMARY OF THE INVENTION

Accordingly, it is an object of the present invention to provide a cellular X-ray grid which avoids the disadvantages of the prior art.

More particularly, it is an object of the present invention to provide a cellular X-ray grid which is characterized with higher informative property and improved operational parameters.

In keeping with these objects and with others which will become apparent hereinafter, one feature of the present invention resides, briefly stated, in a cellular X-ray grid in which, in order to provide a complete erasing of the image of the cells during its movement over the time of X-ray examinations, the cells are formed so that on a plan view not a single side of the cells is parallel to a side of the grid which is parallel to its movement, and each side of the cells is arranged at an angle to the side parallel to the directional movement of the grid, which provides a complete eliminating of the shadow images of the cells on the X-ray images during X-ray process during the movement of the grid.

In accordance with another feature of the present invention, the sides of the cells can be arranged relative to the above mentioned side of the grid at angles calculated in accordance with Mattson formulas, as disclosed in Acta Radiologica, Suppl. 120 (1955, from page 85 to the end).

In accordance with another feature of the present invention in order to increase the strength of the grid and prevent its bending along its perimeter or along a part of its perimeter, a monolithic, solid frame is arranged around the main body of the grid and has a height corresponding to the height of the main body and a width sufficient for preventing bending of the grid under the action of loads during its use.

In accordance with a further feature of the present invention, in order to increase the impact strength of the grid that is important during its transportation and service of the X-ray apparatus including the grid, the upper and lower surfaces of the grid are protected by a thin X-ray transmitting plate which is firmly connected with the ends of the partitions and the frame. The frame, and also the main part of the grid when there is no frame, together with the ends of the plates form the end parts of the grid, and the plates themselves form the planes of the grid.

In order to improve X-ray absorbing properties of the grid, an X-ray absorbing material covers not only the internal surfaces of the partitions of the grid but also the end surfaces of the partitions and also the frame. In other words the X-ray absorbing material covers all surfaces of the grid which are exposed to liquid or gas before protection by the plates.

Finally, in accordance with a further feature of the present invention in order to provide maximum possible transmittance for the long wave component of the exposing X-ray radiation, each cell of the grid is filled either with gas (including air) or vacuum.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
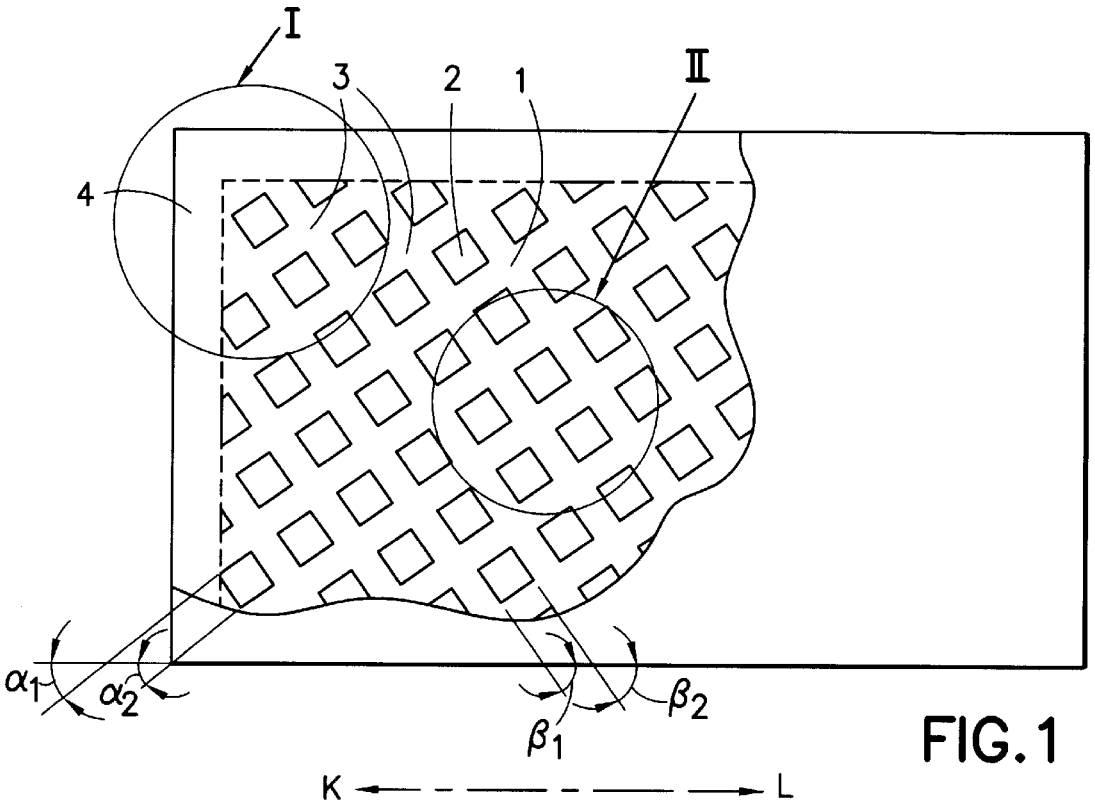
FIG. 1 is a plan view of a cellular X-ray grid in accordance with the present invention.

An X-ray grid in accordance with the present invention has a main part as a plate and identified with reference numeral 1. The main part is composed of photo-sensitive glass and provided with a plurality of cells identified with reference numeral 2. The cells 2 are separated from one another by partitions 3. The size of the cells and the partitions are determined in dependence on the predetermined number of cells/cm$^2$. During the exposure of the X-ray image, the grid is movable in a predetermined direction identified with the arrow K-L. As can be seen from FIG. 1, the cells are arranged so that none of its sides is parallel to the side of the grid which is parallel to the direction of movement of the grid. In particular, each side of the cell is located at such an angle to the side extending parallel to the direction of movement of the grid that a complete eliminating of the shadow images of the cells on the X-ray gram is achieved during the process of X-ray exposure with the movement of the grid. The angles of the inclination of the sides of the cells with respect to the side of the grid which is parallel to the direction of movement of the grid are determined in correspondence with the formulas of Mettson in accordance with one of the following angles:

$\tan \alpha_1 = l/3l+3i$; $\tan \alpha_2 = l/2l+2i$; $\tan \alpha_3 = l/l+i$;

$\tan \alpha_4 = 2l+i/l+i$; $\tan \alpha_5 = 3l+2i/l+i$;

$\tan \alpha_6 = 2l+i/2l+2i$; $\tan \alpha_7 = l+i/3l+2i$;

$\tan \alpha_8 = l+i/2l+i$; $\tan \alpha_9 = l+i/l$;

$\tan \alpha_{10} = 2l+2i/l$; $\tan \alpha_{11} = 3l+3i/l$;

$\tan \alpha_{12} = 2l+2i/2l+i$ wherein l is a thickness of each of the partitions in a direction perpendicular to the side of two neighboring ones of the cells, and i is a length of the side of each of the cells, $\alpha_1$–$\alpha_{12}$ are angles of inclination of sides of said cells to the intended direction of motion of the grid which, in turn, is parallel to the longitudinal sides of said main body.

In accordance with a further feature of the present invention, a frame 4 surrounds the main part of the inventive grid. The frame has a height corresponding to the height of the main part of the grid and a width selected so as to prevent bending of the grid under the action of corresponding loads.

The partitions 3 and the lining are completely covered with an X-ray absorbing layer 5 which is formed as one-piece uninterrupted layer covering all surfaces of the partitions and all surfaces of the frame. The layer 5 has a thickness which provides complete absorption of dispersed radiation which impinges on it. Finally, grates or covers 6 and 7 are arranged at both sides of the grid and fixedly connected with the partitions 3 and the frame 4. The plates 6 and 7 are transmitting for long wave component of the exposing X-ray radiation and protect the grid impact loads. The X-ray absorbing material covers not only the inner surfaces of the partitions of the grid but also the end surfaces of the partitions and the frame or in other words all surfaces of the main grid portion and the frame.

Figure 2:
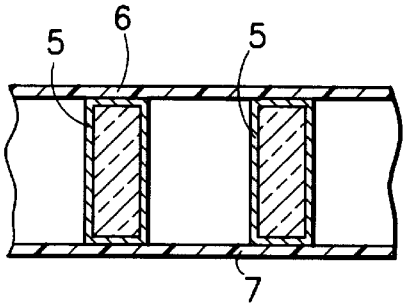
FIG. 2 is a side section part view of the grid in accordance with one embodiment of the present invention.
Figure 3:
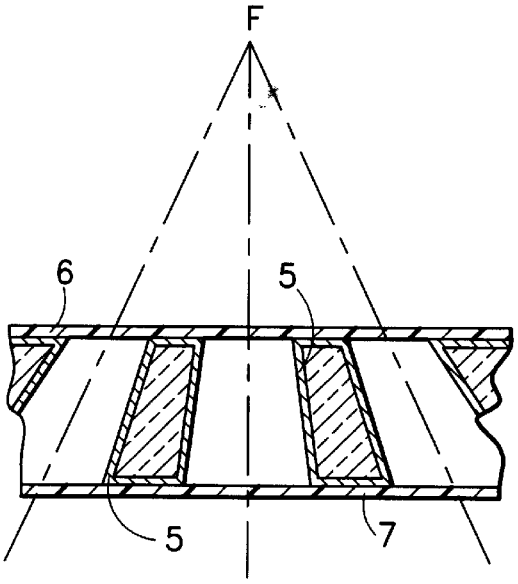
FIG. 3 is a side view of the grid in accordance with the present invention in accordance with another embodiment, both FIGS. 2 and 3 showing a part II of FIG. 1.
Figure 4:
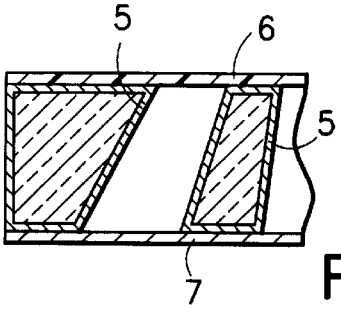
FIG. 4 is a section side view of a part I of the inventive grid as shown in FIG. 1.

Each cell of the grid is filled with gas (air) or vacuum. FIG. 2 shows a so-called parallel grid in which the axes of the cells extend perpendicular to the plane of the grid. In contrast, FIG. 3 shows the cells of a so-called focused grid, in which the axes of the cells are inclined relative to the line extending through the focal point of the X-ray radiation source which corresponds to the focal point of cellular grid and perpendicular to the surface of the grid.

It will be understood that each of the elements described above, or two or more together, may also find a useful application in other types of constructions differing from the types described above.

While the invention has been illustrated and described as embodied in a cellular X-ray grid, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A flat focused cellular grid comprising two opposite flat end surfaces as an uppper surface and a lower surface, and a focal point and a plurality of throughgoing holes named cells extending through said grid from one of said end surface to the other said end surface, said cells are separated by a plurality of X-ray absorbing partitions each of said partitions facing one of said cells, and on a cross-section of a side view of said grid each of the sides of said cells are formed along the hypotenuse of a right triangle formed by said hypotenuse extending from the intersection of said side of said cells with said lower surface of said grid to said focal point and by perpendicular of said focal point to said lower surface of said grid and also by said lower surface of said grid between said intersection of said side of said cell and intersection with said perpendicular from said focal point, said sides of said cells having different lengths from said upper surface to said lower surface for each said side of each said cell and said length for each of said sides of each of said cell is proportional to said hypotenuse corresponding to each said side, said cells in a view of one of said end surfaces farther having sides that are neither parallel to direction of movement of said grid during exposure by x-ray through said grid, and the angles that each side of each said cell of said grid in said view of one said end surfaces makes with the said direction of said movement of said grid provide a complete erasing of images of said cells on the x-ray image obtained during an x-ray procedure with said movement of said grid, and means for moving of said grid in said direction during an x-ray exposure procedure.

2. A cellular grid as defined in claim 1 wherein said cells are filled with gas including air.

3. A cellular grid as defined in claim 1 wherein said cells are vacuumed.

4. A cellular X-ray grid as defined in claim 1 and further comprising a layer of an X-ray absorbing material covering all surfaces of said partitions.

5. A cellular x-ray grid as defined in claim 1 surrounded by a frame.

6. A cellular X-ray grid as defined in claim 1 wherein said upper and lower surfaces are covered with protective plates composed of X-ray material transmitting for long wave components of X-ray radiation.

7. A cellular X-ray grid as defined in claim 6 wherein said protective plates are connected with said upper surface and said lower surface of said grid.

8. A cellular grid as defined in claim 1 which has at least one side arranged parallel to said direction of said movement of said grid.

* * * * *

US005970118C1

(12) EX PARTE REEXAMINATION CERTIFICATE (10431st)

United States Patent
Sokolov

(10) Number: US 5,970,118 C1
(45) Certificate Issued: Dec. 12, 2014

(54) CELLULAR X-RAY GRID

(76) Inventor: Oleg Sokolov, Rego Park, NY (US)

Reexamination Request:
No. 90/007,755, Oct. 3, 2005

Reexamination Certificate for:

| | |
|---|---|
| Patent No.: | **5,970,118** |
| Issued: | **Oct. 19, 1999** |
| Appl. No.: | **08/924,497** |
| Filed: | **Aug. 27, 1997** |

Related U.S. Application Data

(63) Continuation of application No. 08/615,724, filed on Mar. 14, 1996, now abandoned, which is a continuation of application No. 08/370,827, filed on Jan. 10, 1995, now abandoned, which is a continuation of application No. 08/009,982, filed on Jan. 27, 1993, now abandoned.

(51) Int. Cl.
*G21K 1/02* (2006.01)

(52) U.S. Cl.
USPC ..... 378/155; 250/505.1

(58) Field of Classification Search
USPC ..... 378/154, 155; 250/505.1
See application file for complete search history.

(56) References Cited

To view the complete listing of prior art documents cited during the proceeding for Reexamination Control Number 90/007,755, please refer to the USPTO's public Patent Application Information Retrieval (PAIR) system under the Display References tab.

*Primary Examiner* — Margaret Rubin

(57) ABSTRACT

A cellular X-ray grid comprises a main grid portion having a plurality of cells separated from one another by a plurality of partitions, the main portion has on a plan view a side which extends parallel to a direction of movement of the grid during exposure, the cells having sides arranged so that the sides of the cells are not parallel to the side of the main portion which is parallel to the direction of movement of the grid and extend relative to the side of the main portion at such an angle as to erase an image of the cells on an X-ray picture during exposing with the movement of the grid, the cells contain gas or vacuum.

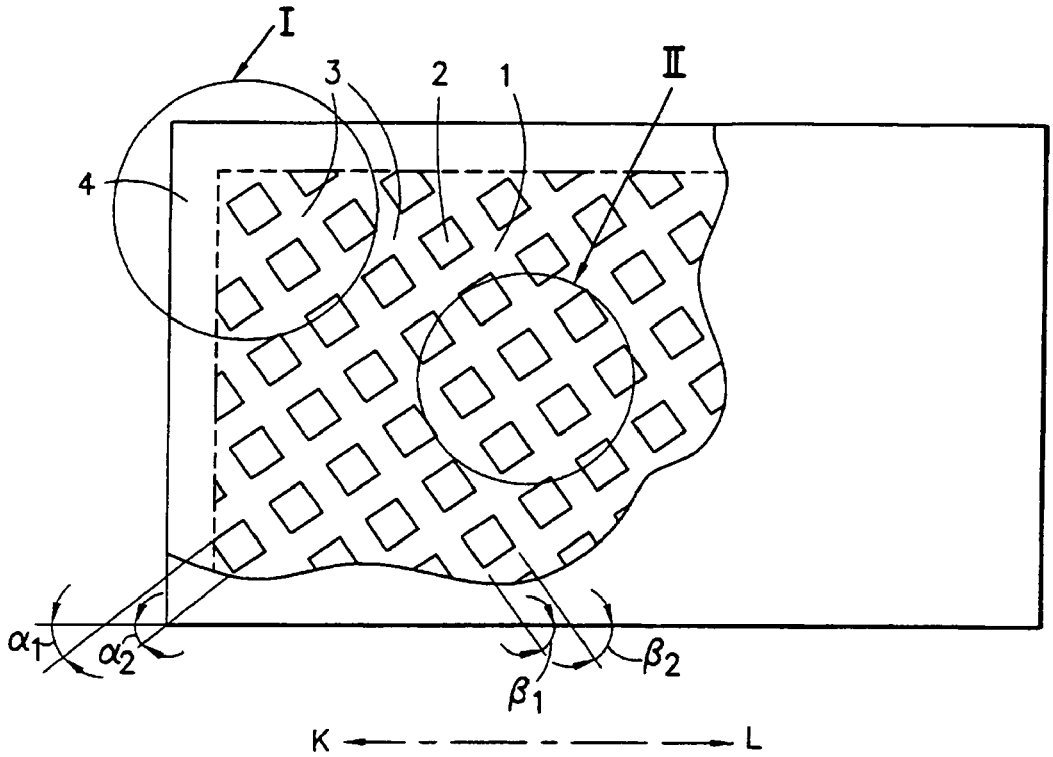

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-8 is confirmed.

* * * * *